US006814063B2

(12) United States Patent
Kawano et al.

(10) Patent No.: US 6,814,063 B2
(45) Date of Patent: Nov. 9, 2004

(54) CONTROL OF FUEL VAPOR PROCESSING DEVICE

(75) Inventors: Akihiro Kawano, Atsugi (JP); Masaya Furushou, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/459,444

(22) Filed: Jun. 12, 2003

(65) Prior Publication Data

US 2004/0007215 A1 Jan. 15, 2004

(30) Foreign Application Priority Data

Jul. 15, 2002 (JP) ..... 2002-205357

(51) Int. Cl.[7] ..... F02M 37/04
(52) U.S. Cl. ..... 123/520; 123/516
(58) Field of Search ..... 123/520, 519, 123/518, 516, 521, 198 D, 357

(56) References Cited

U.S. PATENT DOCUMENTS 4,949,695 A * 8/1990 Uranishi et al. ..... 123/520
5,443,051 A * 8/1995 Otsuka ..... 123/520
5,497,754 A * 3/1996 Ito ..... 123/520
5,730,107 A * 3/1998 Blumenstock ..... 123/520
6,192,742 B1 * 2/2001 Miwa et al. ..... 73/40
6,453,887 B1 * 9/2002 Hayashi et al. ..... 123/520
6,467,464 B2 * 10/2002 Burke et al. ..... 123/520

FOREIGN PATENT DOCUMENTS

JP 5-47403 A 2/1993

* cited by examiner

*Primary Examiner*—Carl S. Miiler
(74) *Attorney, Agent, or Firm*—Foley & Lardner LLP

(57) ABSTRACT

Fuel vapor from a fuel tank (4) of an engine (1) is adsorbed by a canister (6) via a first passage (9). The canister (6) comprises an air vent (11) which communicates with the atmosphere. The canister (6) communicates with an intake passage (2) of the engine (1) via a second passage (10) provided with a purge valve (13). When the air vent (11) and purge valve (13) are opened, the adsorbed fuel in the canister (6) is purged to the intake passage (2) due to the intake negative pressure of the engine (1). If the negative pressure of the second passage (10) becomes stronger than a reference negative pressure during purging, the purge valve (13) is throttled to prevent an excessive negative pressure from acting on the fuel tank (4).

11 Claims, 4 Drawing Sheets

CONTROL OF FUEL VAPOR PROCESSING DEVICE

FIELD OF THE INVENTION

This invention relates to a fuel vapor processing device for vehicles.

BACKGROUND OF THE INVENTION

JP5-47403A published by the Japanese Patent Office in 1993 discloses a pressure control valve in the middle of a vent passage which sends the fuel vapor in a fuel tank for vehicles into a canister. The canister contains a fuel adsorption material such as activated carbon, and the fuel vapor in the fuel tank flows into the canister through a vent passage according to the pressure buildup of the fuel tank, and is adsorbed by the adsorption material. The canister is provided with a vent pipe which communicates with the atmosphere.

When an intake passage goes to negative pressure due to operation of an engine, the fuel vapor is drawn out of the adsorption material, aspirated into the intake passage via a purge passage together with the air introduced from a vent pipe, and burnt in the engine.

If the vent pipe becomes clogged, the negative pressure of the intake passage acts directly on the fuel tank via a purge passage and vent pipe due to the operation of the engine, and if this state continues for a long time, the fuel tank may deform. According to the prior art, the pressure control valve closes the vent pipe upon detection of a negative pressure in the vent pipe so as to prevent the negative pressure from acting on the fuel tank.

SUMMARY OF THE INVENTION

In such a fuel vapor processing device, it is necessary to occasionally check whether or not a fuel leak has occurred in the fuel vapor path, and a leak diagnosis is performed for this purpose. The diagnosis is carried out by closing the vent pipe of the canister, introducing a negative pressure from the intake passage to the fuel tank, and closing a purge valve provided in the purge passage so as to seal the section from the fuel tank to the purge valve. In this state, the pressure of the sealed section is monitored, and the presence of a leak is diagnosed from a pressure change.

However, if a pressure control valve is provided in the middle of the vent passage as in the prior art, it is impossible to apply a negative pressure to the fuel tank, and to diagnose a fuel leak. In order to enable fuel leak diagnosis, the pressure control valve must have a special mechanism so that communication between the fuel tank and canister is maintained even under a negative pressure during leak diagnosis. This complicates the construction of the fuel vapor processing system and leads to increased manufacturing costs.

It is therefore an object of this invention to prevent the action of an excessive negative pressure on a fuel tank while enabling leak diagnosis in a simple construction.

In order to achieve the above object, this invention provides a fuel vapor processing device for use with an engine which burns air from an intake passage and fuel supplied from a fuel tank. The device comprises a canister which adsorbs fuel vapor in the fuel tank, a first passage which connects the fuel tank and the canister, a second passage which connects the canister and the intake passage. The canister has an air vent which communicates with the atmosphere and a purge valve is installed in the second passage. The device further comprises a pressure sensor which detects a negative pressure in a section leading from the purge valve to the fuel tank via the first passage, canister and second passage, and a programmable controller which controls the opening of the purge valve according to the negative pressure.

The controller is programmed to compare the negative pressure, when the purge valve is open, with a reference negative pressure, and decrease the opening of the purge valve when a magnitude of the negative pressure is larger than a magnitude of the reference negative pressure.

This invention also provides a control method of a fuel vapor processing device for use with an engine which burns air from an intake passage and fuel supplied from a fuel tank. The fuel vapor processing device comprises a canister which adsorbs fuel vapor in the fuel tank, a first passage which connects the fuel tank and the canister, and a second passage which connects the canister and the intake passage. The canister has an air vent which communicates with the atmosphere and a purge valve is installed in the second passage.

The control method comprises detecting a negative pressure in a section leading from the purge valve to the fuel tank via the first passage, canister and second passage, comparing the negative pressure, when the purge valve is open, with a reference negative pressure, and decreasing an opening of the purge valve when a magnitude of the negative pressure is larger than a magnitude of the reference negative pressure.

The details as well as other features and advantages of this invention are set forth in the remainder of the specification and are shown in the accompanying drawings.

DESCRIPTION OF THE PREFERRED EMBODIMENTS

Figure 1:
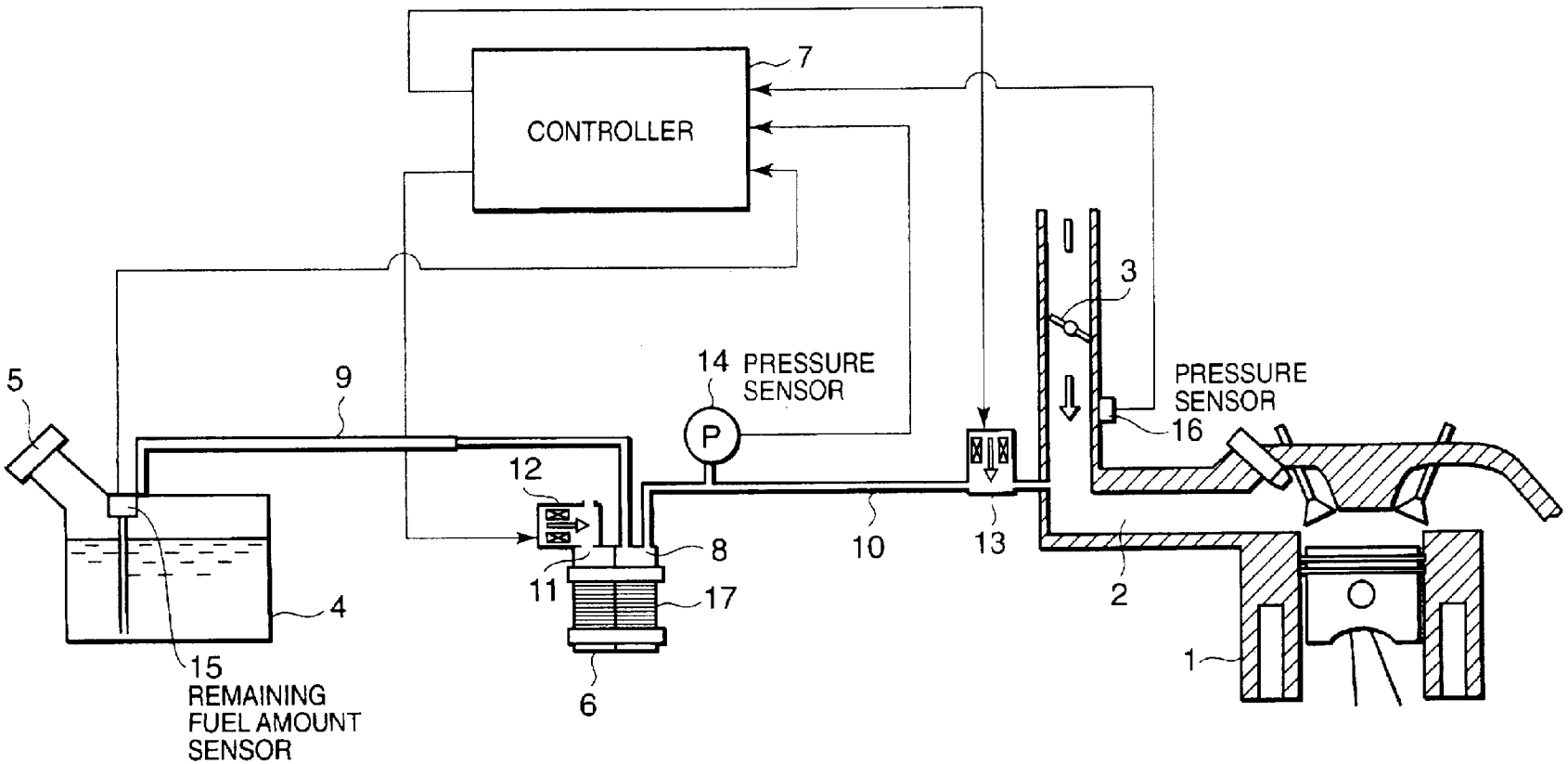
FIG. 1 is a schematic diagram of a fuel vapor processing device according to this invention.

Referring to FIG. 1 of the drawings, a fuel vapor processing device according to this invention comprises a first passage 9 which leads fuel vapor in a fuel tank 4 to a canister 6, and a second passage 10 in which the fuel adsorbed by the canister 6 is aspirated into an intake passage 2 of a combustion engine 1 of a vehicle.

One end of the first passage 9 opens out facing an upper space leading to a filler cap of the fuel tank 4. The canister 6 comprises a fuel adsorbent material 17 formed of active carbon or the like. The other end of the first passage 9 opens out onto a fuel vapor inlet/outlet part 8 provided above the absorbent material 17 of the canister 6. One end of the second passage 10 also opens out onto this fuel vapor inlet/outlet part 8.

The other end of the second passage 10 opens out downstream of the intake passage 2 of the engine 1.

The canister 6 is provided with an air vent 11 communicating with the atmosphere and an electromagnetic valve 12 for opening and closing the air vent 11. The second passage is provided with a purge valve 13. The electromagnetic valve 12 is a valve which selectively applies a fully open or a fully closed state according to a signal from a controller 7. The purge valve 13 is a linear solenoid valve which continuously varies the opening degree according to an opening signal output from the controller 7.

The controller 7 comprises a central processing unit (CPU), read-only memory (ROM), random access memory (RAM) and input/output interface (I/O interface). The controller may also comprise plural microcomputers.

In order to control the opening and closing of the electromagnetic valve 12 and the opening degree of the purge valve 13 by the controller 7, a pressure sensor 14 is provided in the second passage 14 and a pressure sensor 16 is provided in the intake passage 2 of the engine 1. Herein, the pressure sensor 14 is a sensor which detects an absolute pressure while the pressure sensor 16 is a sensor which detects a relative pressure with respect to the atmospheric pressure. The pressures detected by these sensors are input as signals to the controller 7.

When the purge valve 13 is closed and the electromagnetic valve 12 is open, fuel vapor which has vaporized in the fuel tank 4 flows into the canister 6 via the first passage 9 due to the pressure rise of the fuel tank 4, and is adsorbed by the absorbent material 17. This fuel vapor collection is performed irrespective of the engine 1 running or not running. After the fuel vapor has been absorbed by the absorbent material 17, the excess pressure is released from the electromagnetic valve 12 to the atmosphere via the air vent 11.

When the electromagnetic valve 12 and purge valve 13 are both opened during operation of the engine 1, the negative pressure in the intake passage 2 acts on the canister 6 via the second passage 10. As a result, air is aspirated from the air vent 11 via the electromagnetic valve 12, flows into the intake passage 2 from the second passage 10 together with fuel adsorbed by the absorbent material 17, and is burnt in the engine 1.

When a leak test is performed to determine whether or not there is a leak, the electromagnetic valve 12 is closed, the purge valve 13 is opened, and the negative pressure in the intake passage 2 is introduced into the fuel tank 4, second passage 9, canister 6 and first passage 10. When the pressure detected by the pressure sensor 14 has reached a preset pressure, the purge valve 13 is fully closed so as to seal the section from the purge valve 13 to the fuel tank 4. In this state, the pressure detected by the pressure sensor 14 is monitored, and the presence or absence of a fuel leak in this section is diagnosed from the nature of its variation.

In this fuel vapor processing device, apart from during a leak test, when a large negative pressure is acting on the fuel tank 4, the controller 7 lowers the negative pressure acting on the fuel tank 4 by reducing the opening of the purge valve 13.

Figure 2:
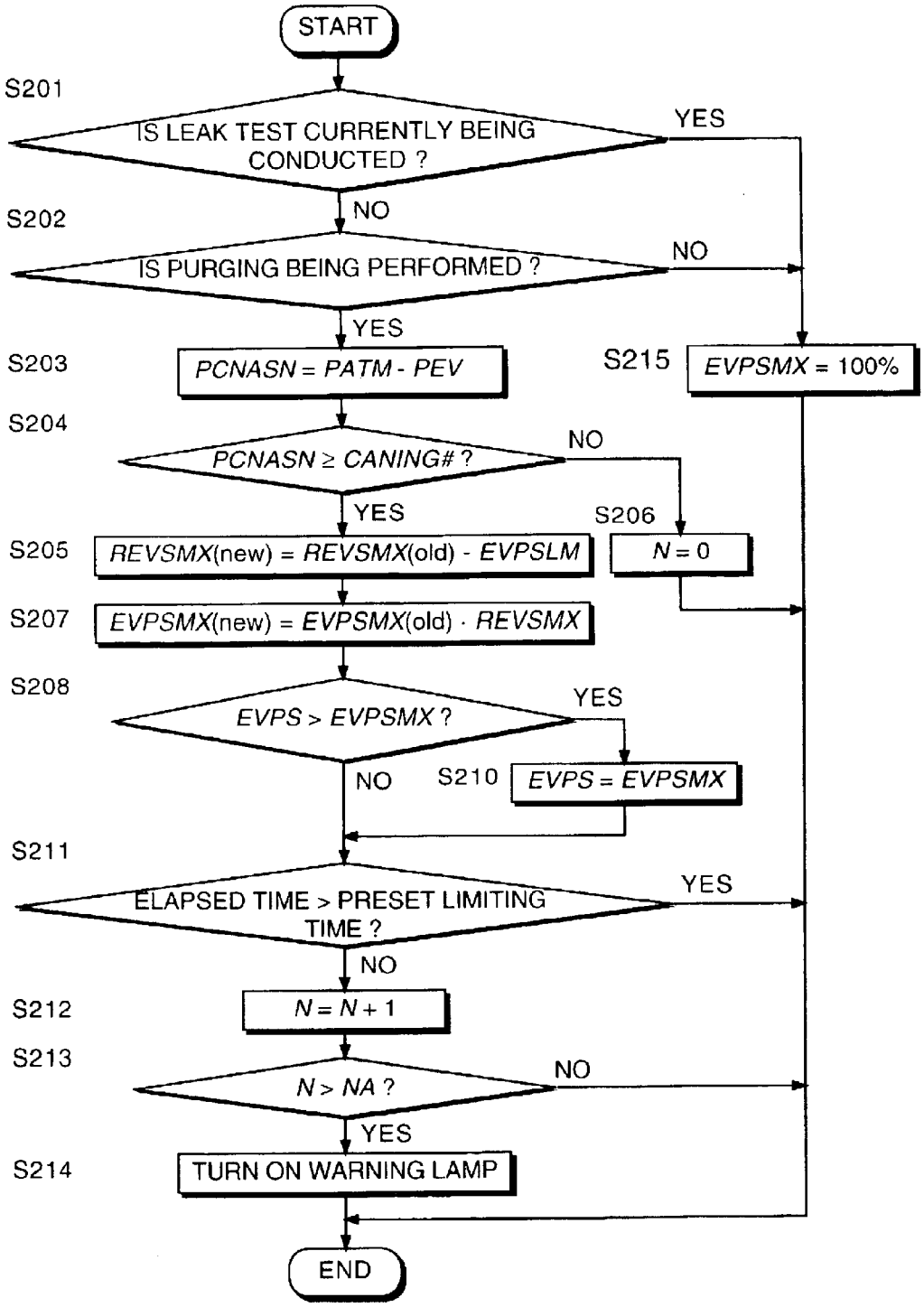
FIG. 2 is a flowchart describing a purge valve opening limiting routine executed by a controller according to this invention.

Referring to FIG. 2, a purge valve opening limiting routine executed by the controller 7 for this purpose will be described. This routine is executed at an interval of 100 milliseconds during operation of the engine 1.

First, in a step S201, the controller 7 determines whether or not a leak test is currently being conducted.

As described above, the purpose of this routine is to prevent a negative pressure which would deform the fuel tank 4 from acting on the purge valve except during a leak test. Therefore, when a leak test is currently conducted, in a step S215, the controller 7 sets an upper limit EVPSMX of a command opening EVPS of the purge valve 13 to 100%, and terminates the routine.

When a leak test is not currently being conducted, in a step S202, the controller 7 determines whether or not purging of fuel vapor in the canister 6 is being performed. This determination is performed by determining whether or not the command opening EVPS of the purge valve 13 is larger than zero. Specifically, it is determined that when the command opening EVPS is larger than zero, purging is being performed, and when it is zero, purging is not being performed.

The control of purging itself is performed by a purging control routine which is separately programmed. The essentials of the purging control routine are that, when the electromagnetic valve 12 is opened, the opening of the purge valve 13 is controlled based on the running state of the vehicle such as vehicle speed so that the fuel absorbed by the canister 6 is supplied to the intake passage 2.

Therefore, the command opening EVPS of the purge valve 13 is determined by the purging control routine. The function of the purge valve opening limiting routine according to this invention is to limit the command opening EVPS so that a negative pressure which would deform the fuel tank 4 does not act, as a result of the output of the command opening EVPS of the purge valve 13 determined by the purging control routine.

As a result of the determination of the step S202, when purging is being performed, after the processing of the step S215 described earlier, the controller 7 terminates the routine.

When purging is not being performed, in a step S203, the controller 7 calculates the difference between a standard pressure PATM and a pressure PEV in the second passage 10 detected by the pressure sensor 14 as a parameter PCNASN showing the pressure variation. The standard pressure PATM represents atmospheric pressure, and the pressure detected by the pressure sensor 14 when the engine 1 was not running is prestored in the memory of the controller 7 as the standard pressure.

The unit for all pressures used in this routine is atmospheres. Therefore, even in the case of a negative pressure, a negative value is not assigned.

When purge is being performed, the pressure PEV in the second passage 10 is a negative pressure, so it is less than the standard pressure. Therefore, the parameter PCNASN during purge is a positive value. The input of the pressure PEV from the pressure sensor 14 to the controller 7 is performed periodically independently of the execution of this routine, and the controller 7 updates the pressure PEV stored in the memory each time there is an input.

In a following step S204, the controller 7 compares the parameter PCNASN with a reference value CANING#. The reference value CANING# is a value showing the boundary of the negative pressure which deform the fuel tank 4. Herein, the reference value CANING# is set to a value corresponding to 40 mmHg expressed in atmospheres.

As a result of the determination of the step S204, when PCNASN is less than CANING#, the negative pressure acting on the fuel tank 4 does not cause deformation of the fuel tank 4, so in a step S206, after resetting a counter value N to zero, the controller 7 terminates the routine. The counter value N will be described later.

On the other hand, when as a result of the determination of the step S204, PCNASN is not less than CANING#, the controller 7 performs the processing of a step S205 and subsequent steps. Herein, a present value REVSMX(new) of an opening limit factor REVSMX is calculated by subtracting an opening reduction factor EVPSLM from the immediately preceding value REVSMX(old) of the opening limit factor REVSMX of the purge valve 13. The opening limit factor REVSMX is set between 0% and 100%. The initial value of the opening limit factor REVSMX is 100%.

The opening reduction factor EVPSLM shows the opening variation amount in the closing direction of the purge valve 13 per 100 milliseconds which is the routine execution interval. Herein, the opening reduction factor EVPSLM is taken to be 2.4%. The opening reduction factor EVPSLM can also be made to vary as described later.

In a following step S207, the controller 7 calculates a present value EVPSMX(new) of an upper limit EVPSMX of the command opening EVPS by multiplying the immediately preceding value EVPSMX(old) of the upper limit EVPSMX of the command value EVPS of the purge valve 13, by the opening limit factor REVSMX of the purge valve 13 updated in the step S205.

In a following step S208, the controller 7 compares the present command opening EVPS of the purge valve 13 with the updated upper limit EVPSMX.

When the command opening EVPS is larger than the upper limit EVPSMX, the controller 7 limits the command opening EVPS to the upper limit EVPSMX in a step S210, and then performs the processing of a step S211. When the command opening EVPS is not larger than the upper limit EVPSMX, the controller 7 performs the processing of the step S211 without modifying the present opening EVPS.

The initial value of the upper limit EVPSMX of the opening of the purge valve 13 is 100%, but if PCNASN≧CANING#, i.e., if there is a possibility that a negative pressure could deform the fuel tank 4, in the step S205, the purge valve opening limit factor REVSMX is reduced by 2.4% each time the routine is executed.

The upper limit EVPSMX of the command opening EVPS of the purge valve 13 is then updated using the reduced purge valve opening limit factor REVSMX, so the command opening EVPS is limited to the upper limit EVPSMX. This limitation on the command opening EVPS by the upper limit EVPSMX is directly applied to the command opening EVPS output by the aforesaid purging control routine.

Hence, provided that there is a risk of a negative pressure leading to deformation of the fuel tank 4, the upper limit EVPSMX of the opening of the purge valve 13 decreases each time the routine is executed. Even if the upper limit EVPSMX of the opening of the purge valve 13 is decreased, the opening EVPS of the purge valve 13 may not decrease immediately, but provided that the condition PCNAS≧CANING# continues, the upper limit EVPSMX continues to decrease, and finally, in the step S210, the opening EVPS of the purge valve 13 is decreased. Therefore, the decrease of the upper limit EVPSMX of the opening of the purge valve 13 effectively means that the opening EVPS of the purge valve 13 will be decreased.

As a result of the aforesaid processing, the negative pressure acting on the fuel tank 4 from the intake passage 2 becomes weaker, and when PCNASN<CANING#, the value of the upper limit EVPSMX is maintained thereafter.

When it is determined that the leak test has started in the step S201, or when it is determined that purging is no longer performed in the step S202, the upper limit EVPSMX is reset to 100%. However, the purge valve opening limit factor REVSMX is not reset, so after purging is complete, the upper limit EVPSMX when purging is restarted decreases at a faster rate than on the immediately preceding occasion, and a good response in the limiting control of the purge valve opening is obtained.

Steps S211–S214 are steps which diagnose the presence or absence of a fault in the fuel vapor processing device.

Herein, if each time the processing of the step S205 and subsequent steps is performed, i.e., if it is determined that a negative pressure which could deform the fuel tank 4 is continuously acting, it is determined that there is a fault in the fuel vapor processing device, and the driver of the vehicle is notified thereof. In this regard, a fault means a clogging of the air vent 11 or an operating fault in the electromagnetic valve 12.

On the other hand, it may occur that although the control by the controller 7 is correctly performed, the apparent negative pressure becomes excessive due to atmospheric pressure changes. Whereas the pressure sensor 14 detects the pressure dynamically, the standard pressure PATM is the atmospheric pressure detected by the pressure sensor 14 when the engine 1 was not running. Therefore, if the atmospheric pressure varies from the standard pressure PATM on the occasion the routine is executed, an error appears in the calculation of the parameter PCNASN. The atmospheric pressure varies considerably with altitude differences of roads on which the vehicle travels.

For example, if the altitude of the road decreases from when the standard pressure PATM was measured, atmospheric pressure increases. In this case, the parameter PCNASN becomes a smaller value than the actual deviation. Conversely, when the altitude of the road increases, atmospheric pressure decreases. In this case, the parameter PCNASN becomes a larger value than the actual deviation.

If the parameter PCNASN exceeds the reference value CANING#, it will be determined that there is a risk of deforming the fuel tank 4 even if the actual negative pressure is within a range which does not deform the fuel tank 4. The processing of the step S211 is a processing not to determine that there is a fault in the fuel vapor processing device in such a case.

In the step S211, the controller 7 determines whether or not an elapsed time from measurement of the standard pressure PATM exceeds a preset limiting time. If the elapsed time exceeds the limiting time, it is considered that there is a high probability of incorrect determination, and the routine is terminated without performing the determination of whether or not there is a fault in the fuel vapor processing device. It is only when the elapsed time does not exceed the limiting time, that the determination of whether or not there is a fault in the fuel vapor processing device is performed in steps S212–S214.

The step S211 is provided for the reason that the standard pressure PATM corresponds to the atmospheric pressure in the past and it may be different from the atmospheric pressure at present. If the fuel vapor processing device is further provided with an atmospheric pressure sensor and the standard pressure PATM is updated according to the atmospheric pressure detected on every occasion the routine is performed, the step S211 will not be required.

In the step S212, the controller 7 increments the counter value N. As described above, If the parameter PCNASN is less than the reference value CANING# in the step S204, the counter value N is reset to zero in the step S206. Therefore, the counter value signifies a continuous number of occasions on which it was determined that the parameter PCNASN exceeded the reference value CANING# in the step S204.

In the next step S213, the controller 7 compares the counter value N with a predetermined counter value NA. When the counter value N exceeds the predetermined counter value NA, it is assumed that a fault has occurred in the fuel vapor processing device in the step S214, and this is notified to the driver of the vehicle by lighting a warning lamp in the step S214 following which the routine is terminated.

When the counter value N does not exceed the predetermined counter value NA in the step S213, the controller 7 terminates the routine without performing the processing of the step S214.

Next, referring to FIGS. 3A–3D, the opening of the purge valve 13 is increased when purging is performed. In this process, if the pressure in the second passage 10 falls below the atmospheric pressure −40 mmHg as shown by the solid line in FIG. 3C, this negative pressure can affect the fuel tank 4 as shown by the solid line in FIG. 3D, and may deform the fuel tank 4.

Due to the execution of the above routine, when the parameter PCNASN is less than the reference value CANING# in the step S204, the upper limit EVPSMX of the command opening of the purge valve 13 is decreased in the step S207. By repeating this process a certain number of times, as the upper limit EVPSMX gradually decreases, the command opening EVPS eventually exceeds the upper limit EVPSMX in the step S208, and the command opening EVPS of the purge valve 13 is limited to the upper limit EVPSMX in a step S210.

As a result of this processing, the command opening EVPS of the purge valve 13 is made to decrease as shown by the broken line of FIG. 3B, and therefore, the pressure in the second passage 10 is maintained so that it does not fall below the atmospheric pressure −40 mmHg corresponding to the reference value CANING#.

The parameter PCNASN may exceed the reference value CANING# in the step S204 as a result of clogging of the air vent 11 or an operational defect in the electromagnetic valve 12, so that air is no longer supplied from the air vent 11 to the second passage 10. Provided that atmospheric air is supplied from the air vent 11 to the second passage 10, the pressure in the second passage 10 is less likely to fall, the lower the parameter PCNASN is below the determination basic value CANING#.

According to this purge valve opening limiting routine, by throttling the opening EVPS of the purge valve 13 as shown by the dotted line in FIG. 3B, the controller 7 maintains the pressure in the second passage 10 above the atmospheric pressure of −40 mmHg which is shown by the dotted line in FIG. 3C, so a negative pressure below the atmospheric pressure of −40 mmHg does not act on the fuel tank 4, as shown by the broken line in FIG. 3D. Therefore, even if purging is performed when the air vent 11 is clogged or there is an operational fault in the electromagnetic valve 12, a negative pressure which could deform the fuel tank 4 does not act on the fuel tank 4.

Figures 3A, 3B, 3C, 3D:
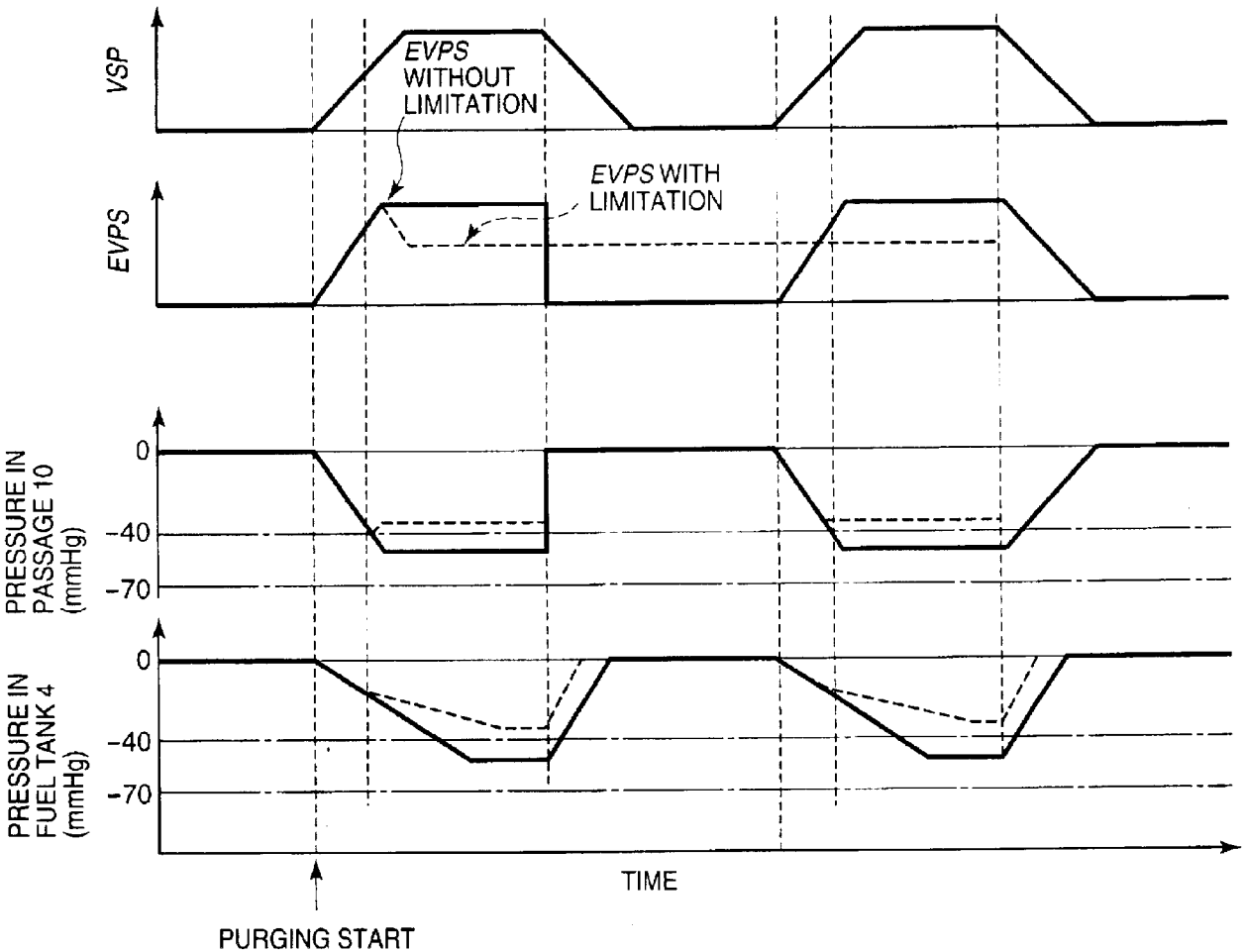
FIGS. 3A–3D are timing charts describing a pressure variation in a passage and fuel tank due to purge valve opening control by the controller.

As shown in FIG. 3A, when a vehicle speed VSP falls, i.e., when the vehicle decelerates, the purge valve 13 immediately closes. This operation is performed by the purging control routine for the following reason. During deceleration, as the throttle 3 is closed, an extremely large negative pressure is temporarily produced in the intake passage 2 downstream of the throttle 3. Hence, the purge valve 13 is immediately closed when the vehicle decelerates so that the extremely large negative pressure does not have any effect on the pressure in the second passage 10.

Thus, after purging is complete, when purging conditions are again satisfied, the controller 7 opens the purge valve 13 via the purging control routine, and purging is resumed. The purge valve opening limit factor REVSMX which determines the upper limit EVPSMX of the opening of the purge valve 13 at this time, is a value set during the latest execution of the step S205 of the purge valve opening limiting routine. In other words, in the second and subsequent purgings, the purge valve opening limit factor REVSMX does not decrease from 100%, but starts to decrease from the value reached on the immediately preceding purging occasion. Therefore, the decrease rate of the upper limit EVPSMX increases, the time until the actual purge valve opening EVPS is decreased by the upper limit EVPSMX is shortened, and control response is enhanced.

According to this embodiment, it was determined whether or not the negative pressure was excessive based on the pressure detected by the pressure sensor 14 in the second passage 10, but if sufficient air is no longer supplied during purging due to a clogging of the air vent 11 or an operational fault in the electromagnetic valve 12, the first passage 9 also develops a negative pressure together with the second passage 10.

Also, the fuel tank 4 finally develops a negative pressure. Therefore, the sensor which performs the determination of whether or not the negative pressure is excessive, may be installed anywhere in the section from the purge valve 13 to the fuel tank 4.

Next, referring to FIG. 4, a second embodiment of this invention relating to the setting of the opening reduction factor EVPSLM will be described.

According to the first embodiment, the opening reduction factor EVPSLM was set to a fixed value of 2.4%, but the time for the negative pressure to reach from the second passage 10 to the fuel tank 4 was different depending on the amount of fuel remaining in the fuel tank 4, the negative pressure of the intake passage 2, and the upper limit EVPSMX of the opening of the purge valve 13.

According to this embodiment, an excessive negative pressure is prevented from acting on the fuel tank 4 by setting the opening reduction factor EVPSLM dynamically according to these parameters.

Figure 4:
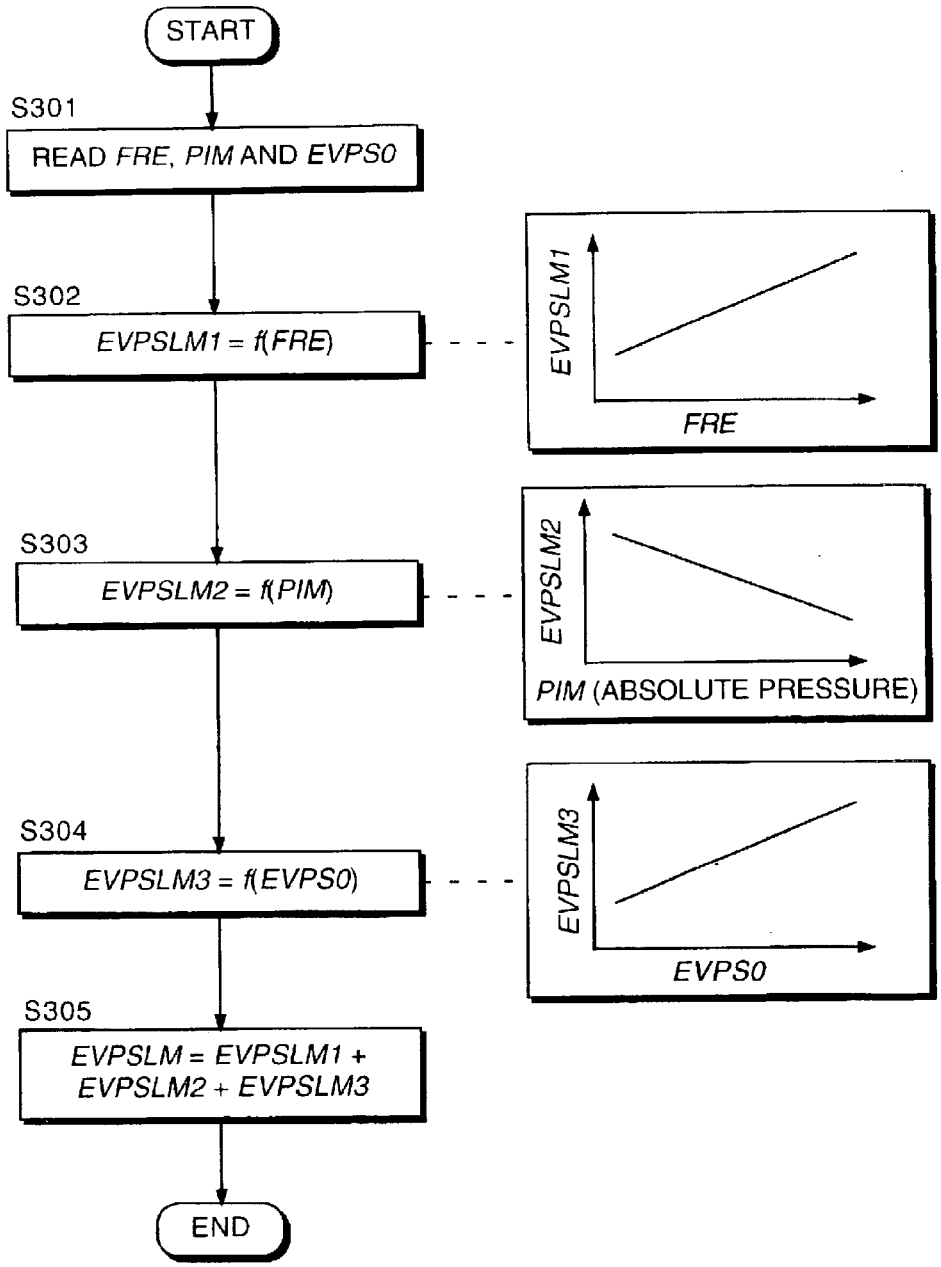
FIG. 4 is a flowchart describing a routine for calculating an opening reduction factor EVPSLM executed by the controller according to a second embodiment of this invention.

This setting is performed by executing a routine for calculating the opening reduction factor EVPSLM shown in FIG. 4. This routine is executed at an interval of 100 milliseconds separately from the aforesaid purging control routine or the purge valve opening limiting routine.

Also, the controller 7 uses the latest value obtained by executing the routine for calculating the opening reduction factor EVPSLM, as the opening reduction factor EVPSLM used in the step S207 of the purge valve opening limiting routine.

To execute this routine for calculating the opening reduction factor EVPSLM, the fuel vapor processing device comprises a remaining fuel amount sensor 15 which detects the remaining amount of fuel in the fuel tank 4. A remaining fuel amount FRE detected by the remaining fuel amount sensor 15 is input to the controller 7 as a signal.

Referring to FIG. 4, first in a step S301, the controller 7 reads the remaining fuel amount FRE detected by the remaining fuel amount sensor 15, an intake pressure PIM of the engine while detected by the pressure sensor 16, and an upper limit EVPS0 of the opening of the purge valve 13. The upper limit EVPS0 of the opening of the purge valve 13 is the latest upper limit EVPSMX calculated by the routine of FIG. 2.

In a next step S302, the controller 7 calculates a first opening reduction factor EVPSLM1 according to the remaining fuel amount FRE by looking up a map of EVSPLM1 having the characteristics shown in the figure which is prestored in an internal memory (ROM).

In a next step S303, a second opening reduction factor EVPSLM2 according to the intake pressure PIM is calculated by looking up a map of EVSPLM2 having the characteristics shown in the figure which is prestored in the internal memory (ROM). In a next step S304, a third opening reduction factor EVPSLM3 according to the upper limit EVPS0 of the opening of the purge valve 13 is calculated by looking up a map of EVSPLM3 having the characteristics shown in the figure which is prestored in the internal memory (ROM).

When the remaining fuel amount FRE in the fuel tank 4 is large, the volume of the space remaining in the fuel tank 4 is small, and the rise of negative pressure occurs earlier. Accordingly in the map of EVPSLM1, a larger value is assigned to the first opening reduction factor EVPSLM1 the larger the remaining fuel amount FRE is.

The lower the intake pressure PIM is, i.e., the larger the magnitude of the intake negative pressure is, the more likely it is that the negative pressure in the second passage 10 will be excessive when there is an obstacle to the introduction of air from the air vent 11. Accordingly in the map of EVPSLM2, a larger value is assigned to the second opening reduction factor EVPSLM2 the lower the intake pressure PIM is.

The larger the upper limit EVPS0 of the opening of the purge valve 13 is, the more easily the intake negative pressure is transmitted to the second passage 10. Accordingly in the map of EVPSLM3, a larger value is assigned to the third opening reduction factor EVPSLM3 the larger the upper limit EVPS0 of the opening of the purge valve 13 is.

The controller 7, in a step S305, sums the first opening reduction factor EVPSLM1, second opening reduction factor EVPSLM2 and third opening reduction factor EVPSLM3, and stores the result as an opening reduction factor EVPSLM in the memory. The stored opening decrease factor EVPSLM is applied on the next occasion when the purge valve opening limiting routine is executed.

The contents of Tokugan 2002-205357, with a filing date of Jul. 15, 2002 in Japan, are hereby incorporated by reference.

Although the invention has been described above by reference to certain embodiments of the invention, the invention is not limited to the embodiments described above. Modifications and variations of the embodiments described above will occur to those skilled in the art, in light of the above teachings.

For example, according to the second embodiment, the opening reduction factor EVPSLM was determined by taking the remaining fuel amount, intake pressure and upper limit EVPS0 of the opening of the purge valve 13 as parameters, but the opening reduction factor EVPSLM can also be determined as a function of only two or one of these three parameters.

In the above embodiments, the parameters are obtained by the sensors 14–16, but this invention does not necessarily depends on the parameter obtaining device and applicable to any fuel vapor processing devices which performs claimed control using claimed parameters.

The embodiments of this invention in which an exclusive property or privilege is claimed are defined as follows:

What is claimed is:

1. A fuel vapor processing device for use with an engine which burns air from an intake passage and fuel supplied from a fuel tank, comprising:

a canister which adsorbs fuel vapor in the fuel tank, the canister having an air vent which communicates with the atmosphere;

a first passage which connects the fuel tank and the canister;

a second passage which connects the canister and the intake passage;

a purge valve installed in the second passage;

a pressure sensor which detects a negative pressure in a section leading from the purge valve to the fuel tank via the first passage, canister and second passage; and a programmable controller programmed to:

compare the negative pressure, when the purge valve is open, with a reference negative pressure; and decrease an opening of the purge valve when a magnitude of the negative pressure is larger than a magnitude of the reference negative pressure by decreasing an upper limit of the opening of the purge valve according to a limit factor which gradually decreases at a predetermined reduction rate, and applying the limit factor immediately prior to a closure of the purge valve, to the limit factor when the purge valve is opened again after the closure.

2. The fuel vapor processing device as defined in claim 1, wherein the pressure sensor is a sensor which detects a pressure in the second passage.

3. The fuel vapor processing device as defined in claim 1, wherein the controller is further programmed to decrease the upper limit of the opening of the purge valve at a fixed time interval, and determine a present value of the upper limit by multiplying a last value of the upper limit set on the immediately preceding occasion by a limit factor calculated on a present occasion.

4. The fuel vapor processing device as defined in claim 1, wherein the predetermined reduction rate of the limit factor is set to a fixed value.

5. The fuel vapor processing device as defined in claim 1, wherein the predetermined reduction rate of the limit factor is set to be a function of a parameter relating to a rate at which negative pressure is transmitted to the fuel tank from the intake passage.

6. The fuel vapor processing device as defined in claim 5, wherein the device further comprises a sensor which detects a remaining fuel amount in the fuel tank as a parameter, and the controller is further programmed to increase the reduction rate as the remaining fuel amount increases.

7. The fuel vapor processing device as defined in claim 5, wherein the device further comprises a sensor which detects an intake negative pressure of the engine as a parameter, and the controller is further programmed to increase the predetermined reduction rate as a magnitude of the intake negative pressure increases.

8. The fuel vapor processing device as defined in claim 5, wherein the controller is further programmed to increase the predetermined reduction rate as the upper limit of the opening of the purge valve increases.

9. The fuel vapor processing device as defined in claim 1, wherein the controller is further programmed to determine whether or not a condition where the magnitude of the negative pressure in the section when the purge valve is open is larger than the magnitude of the reference negative pressure continues for a predetermined time, and issues a warning signal when the condition has continued for the predetermined time.

10. A fuel vapor processing device for use with an engine which burns air from an intake passage and fuel supplied from a fuel tank, comprising:

a canister which adsorbs fuel vapor in the fuel tank, the canister having an air vent which communicates with the atmosphere;

a first passage which connects the fuel tank and the canister;

a second passage which connects the canister and the intake passage;

a purge valve installed in the second passage;

means for detecting a negative pressure in a section leading from the purge valve to the fuel tank via the first passage, canister and second passage;

means for comparing the negative pressure, when the purge valve is open, with a reference negative pressure; and means for decreasing an opening of the purge valve when a magnitude of the negative pressure is larger than a magnitude of the reference negative pressure by decreasing an upper limit of the opening of the purge valve according to a limit factor which gradually decreases at a predetermined reduction rate, and applying the limit factor immediately prior to a closure of the purge valve, to the limit factor when the purge valve is opened again after the closure.

11. A control method of a fuel vapor processing device for use with an engine which burns air from an intake passage and fuel supplied from a fuel tank, the device comprising a canister which adsorbs fuel vapor in the fuel tank, the canister having an air vent which communicates with the atmosphere, a first passage which connects the fuel tank and the canister, and a second passage which connects the canister and the intake passage, the method comprising:

detecting a negative pressure in a section leading from the purge valve to the fuel tank via the first passage, canister and second passage;

comparing the negative pressure, when the purge valve is open, with a reference negative pressure; and decreasing an opening of the purge valve when a magnitude of the negative pressure is larger than a magnitude of the reference negative pressure by decreasing an under limit of the opening of the purge valve according to a limit factor which gradually decreases at a predetermined reduction rate, and applying the limit factor immediately prior to a closure of the purge valve, to the limit factor when the purge valve is opened again after the closure.

* * * * *